US005278734A

United States Patent [19]

Ferber

[11] Patent Number: 5,278,734

[45] Date of Patent: Jan. 11, 1994

[54] LIGHT ILLUMINATING ASSEMBLIES FOR WEARING APPAREL WITH LIGHT ELEMENT SECUREMENT MEANS

[76] Inventor: Andrew R. Ferber, Apt. 10A, 10 Waterside Plz., New York, N.Y. 10010

[21] Appl. No.: 4,718

[22] Filed: Jan. 14, 1993

[51] Int. Cl.[5] ..... F21Y 33/00

[52] U.S. Cl. ..... 362/103; 362/800

[58] Field of Search ..... 362/103, 108, 800, 806

[56] References Cited

U.S. PATENT DOCUMENTS

| | | | |
|---|---|---|---|
| 4,164,008 | 8/1979 | Miller et al. | 362/103 |
| 4,480,293 | 10/1984 | Wells | 362/108 |
| 4,523,259 | 6/1985 | Dorsett et al. | 362/120 |
| 4,570,206 | 2/1986 | Deutsch | 362/103 |
| 4,599,682 | 7/1986 | Stephens | 362/103 |
| 4,602,191 | 7/1986 | Davila | 362/103 |
| 4,709,307 | 11/1987 | Branom | 362/103 |
| 4,774,642 | 9/1988 | Janko et al. | 362/108 |
| 4,823,240 | 4/1989 | Shenker | 362/103 |
| 4,839,777 | 6/1989 | Janko et al. | 362/108 |
| 5,113,325 | 5/1992 | Eisenbraun | 362/103 |
| 5,113,329 | 5/1992 | Lin | 362/238 |
| 5,128,843 | 7/1992 | Guritz | 362/103 |

FOREIGN PATENT DOCUMENTS 2497985 1/1981 France .

*Primary Examiner*—Richard R. Cole

*Attorney, Agent, or Firm*—Lerner, David, Littenberg, Krumholz & Mentlik

[57] ABSTRACT

A light illuminating assembly having at least one light emitting element is operatively associated with the decoration on the exterior of wearing apparel and has an improved assembly for securing the light emitting element in predetermined openings which includes, an enclosure for the light emitting element, a shoulder on the inner end of the enclosure forming a stop to limit the extension of the enclosure from the interior to the exterior of the wearing apparel, the enclosure being threaded adjacent the said inner end so that a threaded nut can be detachably connected to the enclosure after it extends to the exterior of the wearing apparel to removably hold the light emitting element in the predetermined position on the exterior of the wearing apparel so as to illuminate and enhance the decoration when the light emitting element of the light illuminating assembly is placed into operation.

12 Claims, 3 Drawing Sheets

LIGHT ILLUMINATING ASSEMBLIES FOR WEARING APPAREL WITH LIGHT ELEMENT SECUREMENT MEANS

BACKGROUND OF THE INVENTION

This invention relates generally to electrically controlled assemblies with a plurality of light emitting elements for illuminating decorations or designs on the exterior of wearing apparel such as sweatshirts or hats or other accessories and more particularly to an improved securement means for affixing each of the plurality of light emitting elements such as light emitting diodes so as to project light onto the outer surface of the wearing apparel, garment, hat or other accessory for operative relation with the decoration or design to be illuminated.

The use of light illuminating devices and assemblies having light emitting elements such as Light Emitting Diodes (LED) modules for illuminating a decoration or a design applied, painted or printed on wearing apparel, garments, hats or other accessories wherein the LED modules are fastened or otherwise affixed to the outer surface of the wearing apparel, garments, hat or other accessory for illuminating the decoration or design, are a known expedient. There exists various prior art patents which show such light illuminating devices and assemblies as well as various ways for affixing the LED modules into assembled position to accomplish the desired coaction with such decorations or designs; for example, U.S. Pat. Nos. 4,570,206; 4,599,682; 4,709,307; 4,823,240; 4,480,293; 5,113,325; and 5,113,329.

These prior art patents each show some arrangement or device for affixing the associated light emitting units so they can be incorporated in and coact with the decoration or design on the given piece of wearing apparel, garment, hat or other accessory.

When used herein, wearing apparel is intended to mean any form of garment, hat, or other accessory on which a decoration or a design can be affixed, painted or printed and on which light emitting elements can be affixed in accordance with the present invention for the purposes of coacting with, illuminating and enhancing such decorations and designs.

The present invention provides an improved light illuminating device or assembly in which novel securement means for the light emitting element serve to positively but detachably secure the light emitting elements into assembled position relative the decoration or design on any given piece of the wearing apparel by a simple means which facilitates the positioning of the light emitting elements and readily permits removal of the light emitting elements when it is desired to clean the given piece of wearing apparel.

SUMMARY AND OBJECTS OF THE INVENTION

Thus, according to one aspect of the present invention, the electrically operated light illuminating device or assembly for use on wearing apparel having a decoration or design on the exterior includes, at least one or more generally a plurality of light emitting elements projecting from the interior to the exterior portion of the wearing apparel through predetermined openings at the point thereon where the decoration or design is located, a source of electrical power and, a controller for actuating the light emitting elements, connecting means for independently connecting each of the light emitting elements to the source of electrical power, and securement means for detachably connecting the light emitting elements in assembled position including, a shoulder or stop means at the inner end of the light emitting element, and the portion of the light emitting element extending to the exterior of the wearing apparel threaded for operative association with a removable threaded means, and said threaded means and the stop means to detachably connect the light emitting element to the wearing apparel when the light emitting element is in assembled position.

It is another aspect of the present invention that in the embodiments hereinafter described, each of the light emitting elements include, an elongated generally cylindrical closed end tubular member in which the light emitting element is mounted for coaction with a circuit board disposed at the inner or open end which serves as the inner stop or shoulder when the light emitting element or elements are in assembled position, and the tubular member is threaded adjacent the inner end to receive a threaded member at the exterior of the wearing apparel to coact with the inner stop or shoulder for detachably connecting each of the respective light emitting elements in the predetermined opening provided on the wearing apparel.

Accordingly, it is an object of the present invention to provide an improved light illuminating device or assembly which includes, means for removably connecting the light emitting elements to a panel or section of wearing apparel at the point where the wearing apparel has a decoration or a design thereon.

It is another object of the present invention to provide means for removably connecting the light emitting element or elements of an electrically operated light illuminating device or assembly light to wearing apparel having a decoration or design thereon so that the light emitting element or elements and the light illuminating device or assembly can be removed to permit the wearing apparel to be cleaned without risk to either the wearing apparel or the light illuminating device or assembly.

Other objects and advantages will become apparent from the following detailed descriptions of various embodiments of the invention taken in conjunction with the accompanying drawings.

DESCRIPTION OF ONE EMBODIMENT OF THE INVENTION

Figure 1:
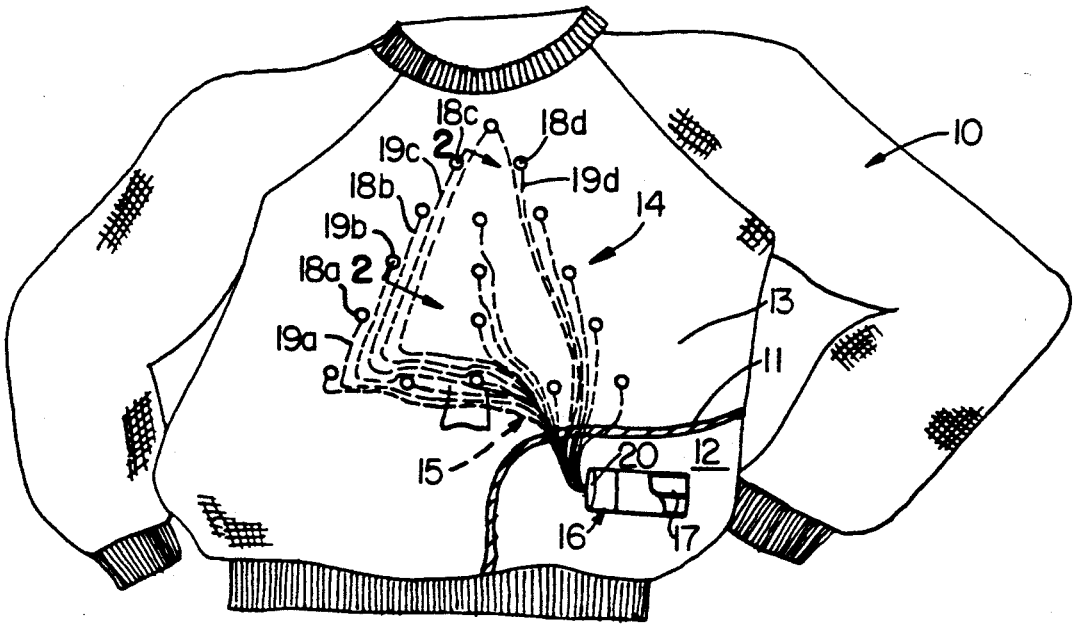
FIG. 1 is a front view of a piece of wearing apparel having a decoration on the front panel and showing generally at a broken away section and in dotted lines one embodiment of the improved light illuminating assembly in accordance with the present invention.

Thus, referring to the drawings, FIG. 1 shows a piece of wearing apparel such as a sweatshirt generally designated 10 with a front panel 11. The front panel 11 defines a space at the interior 12 of the sweatshirt and on the exterior 13 of the front panel 11 a decoration in the form of a Christmas tree generally designated 14 has be imprinted hot stamped, hand drawn or otherwise affixed.

Wearing apparel and more particularly sweatshirts bearing decorations, designs, slogans or other devices on their front panel, rear panel, sides and the like are well known in the commercial marketplace and the illustrated sweatshirt is only intended show one of a multitude of such decorations or designs which can be illuminated or enhanced by an associated light illuminating assembly so affixed to the wearing apparel that the light emitting elements of the light illuminating device or assembly can be brought into cooperative association with the decoration, design, slogan or other printed matter so affixed.

FIG. 1 further shows diagrammatically one type of light illuminating assembly in accordance with the present invention generally designated 15 used to illuminate the decoration 14 as including, a battery pack 16, an electronic controller 17, a plurality of light emitting elements only a few of which are designated as at 18*a*, 18*b*, 18*c* and 18*d* and each of which are connected by electrical connectors as at 19*a*, 19*b*, 19*c* and 19*d* to the said battery pack 16 and electronic controller 17 to control the operation of the light emitting elements so that they either burn steady, flash on and off alternatively in any of a plurality of operation for the particular electrically operated light illuminating device or assembly desired as may be desired.

Any suitable type of switch 20 will be used to place the light illuminating device or assembly into operation after all the elements have been affixed in assembled position.

Figure 2:
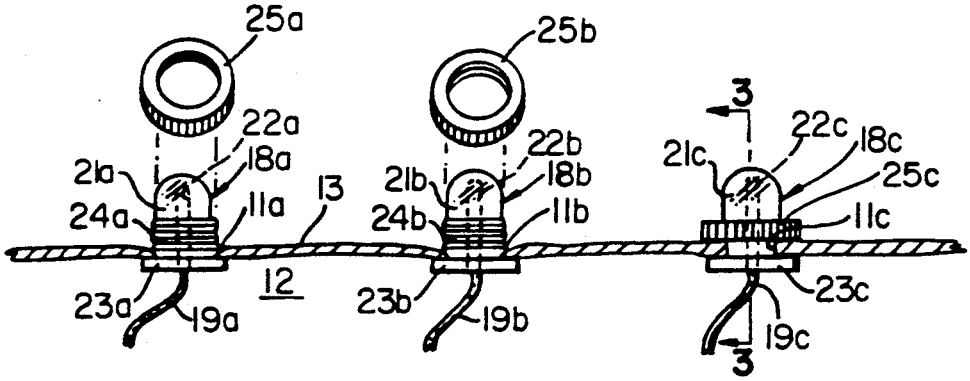
FIG. 2 is a cross-section taken on line 2—2 of FIG. 1.
Figure 3:
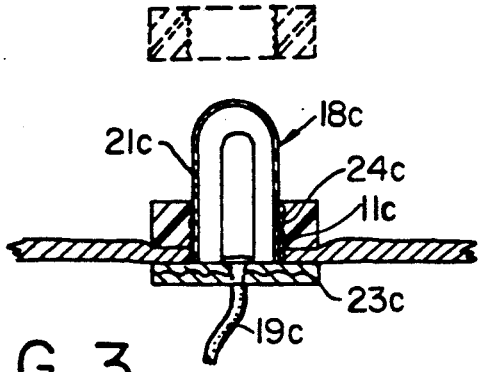
FIG. 3 is an enlarged cross-section taken at line 3—3 of FIG. 2.

The present invention differs from the known prior art devices or assemblies in that it provides an improved securement means for the light emitting elements, as is shown in FIGS. 2 and 3 of the drawings.

Thus, each of the light emitting elements only three of which as at 18*a*, 18*b*, and 18*c* are illustrated, include an elongated tubular cover member or head as at 21*a*, 21*b*, and 21*c* which is closed at one end and open at the opposite end. Light means 22*a*, 22*b* and 22*c* such as light emitting diode (LED) modules which are well known and available in the commercial marketplace are connected to associated circuit boards 23*a*, 23*b* and 23*c*, which in turn are fastened by any suitable means to the open end of the tubular members or heads so that in assembled position the respective light means extend into the tubular members or heads 21*a*, 21*b* and 21*c*, all of which are clearly shown in FIGS. 2 and 3 of the drawings. By further reference to FIGS. 2 and 3, the circuit boards are shown as substantially larger then the diameter of the tubular members or heads for the associated light emitting elements and the significance of this becomes more important when it is noted that the light emitting elements are so associated with panel 11 that they will be disposed to extend through suitable predetermined openings such as 11*a*, 11*b* and 11*c* in the front panel 11 from the interior 12 of the sweatshirt 10 to the exterior 13 so they are disposed to illuminate and enhance the decoration or design 14 on the exterior surface of the front panel 11 for the sweatshirt 10. When this occurs, the respective circuit boards 23*a*, 23*b* and 23*c* are brought into abutment with the inner surface of the front panel 11 to serve as a stop or shoulder for securing the LED modules in assembled position on the front panel 11.

Further, however, in order to fully establish the improved securement means in accordance with the present invention, FIGS. 2 and 3 show that the tubular member or head 21*a*, 21*b* and 21*c* of each of the light emitting elements as at 18*a*, 18*b* and 18*c* are respectively threaded as at 24*a*, 24*b* and 24*c* adjacent the open end and the point of attachment for the circuit boards 23*a*, 23*b* and 23*c*. Thus when the light emitting elements are in assembled position in the predetermined openings 11*a*, 11*b* and 11*c* in the front panel 11 of the sweatshirt 10, the threaded portions 24*a*, 24*b* and 24*c* of the respective tubular members or heads 21*a*, 21*b* and 21*c* will extend to the exterior of the front panel 11 where a threaded nut as at 25*a*, 25*b* and 25*c* can be threaded onto each of the respective tubular members or heads so they can coact with the circuit boards 23*a*, 23*b* and 23*c* each of which act as a shoulder or stop member on the interior of the front panel 11 and together these elements grip the material of which the front panel 11 between them to detachably hold the light emitting element in assembled position to accomplish the desired illumination and enhancing of the Christmas tree or other decoration or design on the front panel 11 of the sweatshirt 10.

When it is desired to remove or separate the light illuminating device or assembly from the sweatshirt so the sweatshirt can be cleaned or otherwise used without the light illuminating device or assembly, the threaded nuts 25*a*, 25*b* and 25*c* are unscrewed from the tubular members or heads 21*a*, 21*b* and 21*c* and the light emitting elements 18*a*, 18*b* and 18*c* can then be removed from their assembled position on the front panel 11 together with all the connecting lines for each of the respective light emitting elements, the battery pack and electronic controller, to free the sweatshirt from the light illuminating device or assembly so that the sweatshirt can be wash, cleaned or otherwise used.

DESCRIPTION OF ANOTHER EMBODIMENT OF THE INVENTION

Figure 4:
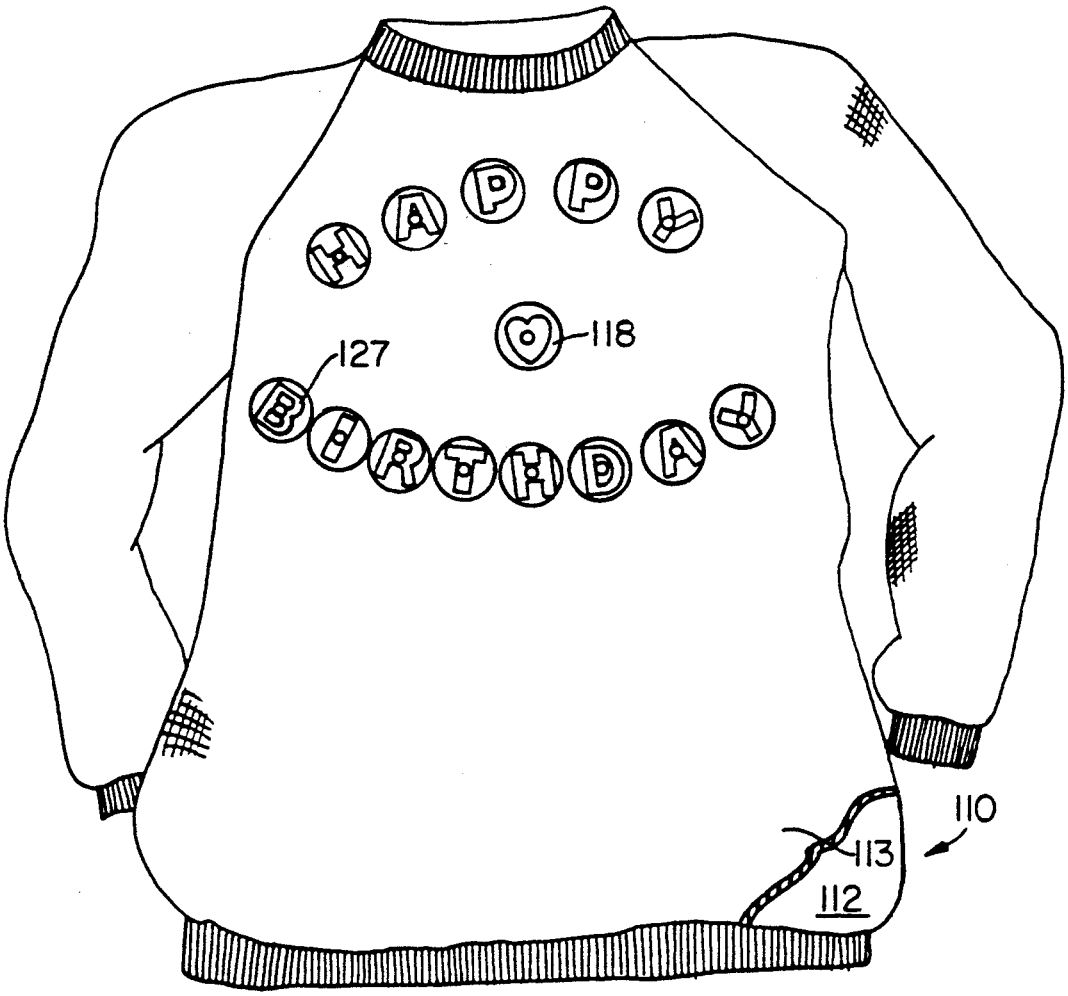
FIG. 4 is another front view of wearing apparel with a different design on the front panel thereof and showing another form of the improved securement means in accordance with the present invention.
Figure 5:
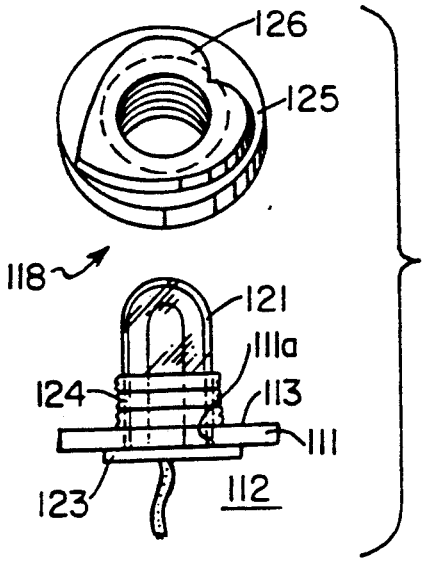
FIG. 5 is an enlarged exploded view partly in vertical section of the securement means for the form of the invention shown in FIG. 4.

FIG. 4 shows a variant of the use of the improved securement means in accordance with the present invention in which the threaded nut is made in the form of a letter or a design such as a heart as shown in FIG. 5.

The light illuminating device or assembly which will include the improved securement means will be the same as that above described for the first form of the invention as shown in FIGS. 1, 2 and 3 and above described. However, the light emitting elements will differ to the extent that the threaded nut operatively related and coacting with the elongated tubular member or head will have a special shape such as a letter or a design such as a heart.

Thus, by reference to FIGS. 4 and 5 it can be seen that the light emitting element generally designated 118 will as in the case of the first form of the invention have an elongated closed end tubular member or head 121.

The elongated closed end tubular member or head 121 will have an operative associate circuit board 123 connected to the open end of the tubular member or head 121 which is larger than the diameter of the said open end and therefor can form a stop or shoulder when the light emitting element 118 is pressed from the interior 112 to the exterior 113 of the sweatshirt 110 through a predetermined opening 111*a* of the front panel 111 for the sweatshirt 110 on which the design or slogan 114 is located as is shown in FIGS. 4 and 5 of the drawings.

Further, the tubular member or head 121 will be threaded as at 124 adjacent the open end of the tubular member or head 121 to which the integrated circuit board 123 is connected so that when it extends to the exterior 113 of the sweatshirt 110, a threaded decorative member as at 125 can be threaded thereon to coact with the stop or shoulder formed by the circuit board 123 to grasp the material of which the front panel 111 is formed there between and thus effectively detachably hold the light emitting element 118 in assembled position on the front panel 111 for the desired operative relation with the design 114 in the same manner as was above described with respect to FIGS. 1,2 and 3 of the drawings for the first form of the present invention.

However, the threaded member 125 in accordance with this form of the improved securement means for the light emitting element 118 will also have a shaped design such as a heart 126 or any other design such as a letter 126*a*, number, not shown, or other indicia for use on the front panel 111 of the sweatshirt 110, as may be desired.

In the case of the threaded member 125, in order to enable the threaded member to function, it is provided with a generally centrally disposed threaded opening 128 so that the design thereon preferably will be centered and the associated light emitting 118 can coact to illuminate and enhance the appearance of such design, letter or the like in assembled position.

Once again in this form of the invention when it is desired to remove light emitting element 118 from assembled position, the threaded member or nut 125 will be unscrewed and once removed will leave the light emitting element 118 free to be removed with its associated connecting line, battery pack, and control panel so the sweatshirt can be cleaned or used without the light illuminating assembly thereon.

DESCRIPTION OF ANOTHER EMBODIMENT OF THE INVENTION

Figure 6:
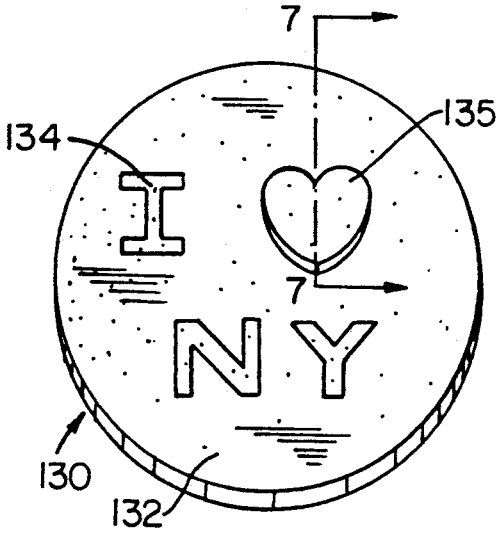
FIG. 6 is a front view of a button having a design on the surface and including another form of the detachable securement means for the light emitting element of the light illuminating assembly.
Figure 7:
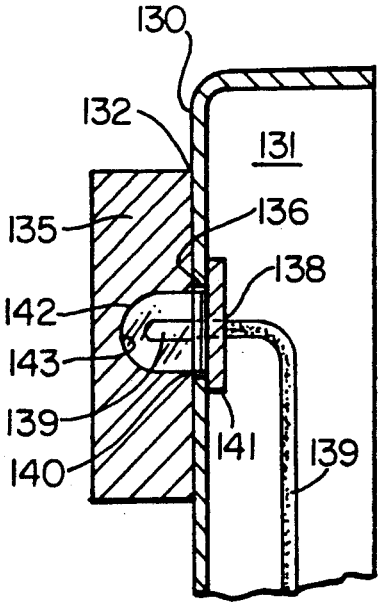
FIG. 7 is a fragmentary cross-section taken on line 7—7 of FIG. 6.

FIGS. 6 and 7 show the application of the improved securement means for the light emitting element or LED module of the light illuminating assembly in accordance with the present invention to a button, and this form of the improved securement means differs in that the light emitting element or LED module is concealed from view but coacts with the material such as a plastic which is transparent or translucent and of course can be colored so that the light from the light emitting element or LED module can shine through or will be transmitted through the threaded member of the improved securement means.

Thus the button generally designated 130 which has a wall 131 made of any suitable type of supporting material shaped to provide an interior section 132 and an exterior surface 133. The button has a design generally designated 134 which in the design illustrated at FIG. 6 includes a heart-shaped threaded member 135.

FIG. 7 shows an LED module generally designated 136 in accordance with this form of the invention which includes the tubular member or head 137 having at least an opening at one end and an associated circuit board 138 with an LED element 139 so connected that when the circuit board 138 is attached to the open end of the tubular member 137, the LED element 139 extends into the tubular member 137. The LED element has a connecting line 139*a* for connecting it to the associated elements of the light illuminating assembly, not shown.

Further, as in the earlier form of the invention above described, the tubular member is threaded as at 140 adjacent the open end so that when the LED module 136 is fitted through an opening 141 in the wall 131 of button 130, it will extend from the interior 131 so that the threaded section 140 will lie beyond the exterior surface 132 where it can receive and coact with the heart-shaped member 135. For this purpose the heart-shaped threaded member 135 is provided with a cavity 142 which is internally threaded at 143 and will fit on and engage the threaded section 140 of the tubular member 137 on the LED module.

The heart-shaped member 135, when so assembled, will detachably hold the LED module 136 by coacting with the circuit board 138 to grasp there between the wall 131 of the button 130.

Since the heart-shaped threaded member 135 can be made of a plastic or the like material, which is transparent or translucent, when the LED element 139 is lighted by operation of the electric source, not shown, of the associated light illuminating assembly, also not shown, identical with the elements as above described for the form of the invention shown in FIGS. 1 through 5 of the drawings, the light will shine through the heart-shaped threaded member 135.

When it is desired, the heart-shaped threaded member can be unscrewed and the LED module 136 can be removed from assembled position on the button along with the other elements of the associated light illuminating assembly and can be replaced with a different design as may be desired.

DESCRIPTION OF STILL ANOTHER EMBODIMENT OF THE INVENTION

Figure 8:
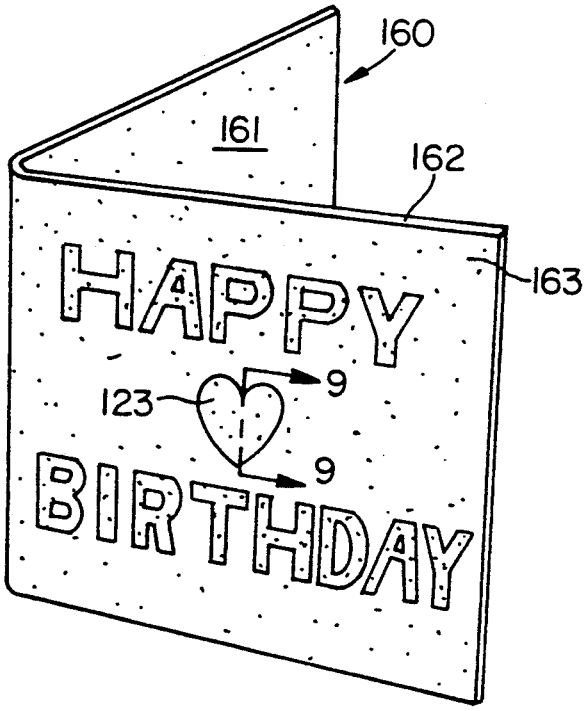
FIG. 8 shows a greeting card with a design on one of the outer faces which shows use of the same form of the detachable securement means for the light emitting element of the light illuminating assembly as is shown in FIGS. 6 and 7.
Figure 9:
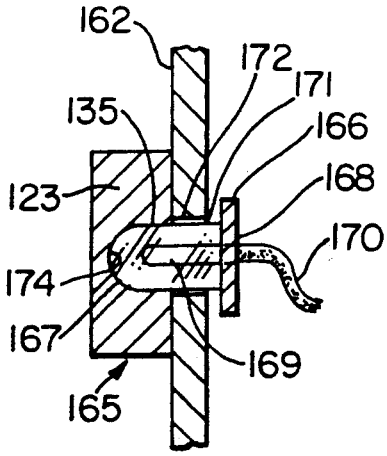
FIG. 9 is a fragmentary partial cross-section taken on line 9—9 of FIG. 8.

FIGS. 8 and 9 show another embodiment of the form of the improved securement means as described above for the form of the invention shown in FIGS. 6 and 7

Thus, greeting or birthday card generally designated 160 is shown having an inside section 161, a front panel 162 with an exterior surface 163. The front panel 162 has a design, slogan or greeting 164 on the exterior surface 163 of the front panel.

An LED module generally designated 165 is connected to the front panel and includes 1 tubular member or head 167 which has an opening at one end. A circuit board 168 is connected to the open end and an LED element 169 is connected to the circuit board 168 so that when the circuit board is in assembled position, the LED element will extend into the tubular member or head 167. The LED element 169 is connected by a connecting line 170 to the remaining elements of the light illuminating assembly, not shown, and is operatively associated therewith so when the light illuminating assembly is placed in operation, the LED element will light up or flash on and off alternatively and selectively, depending on the desired operation.

The LED module 165 extends through a predetermined opening 171 in the front panel 162 of the greeting card 160 so that a threaded portion 172 will extend beyond the exterior surface 163 of the front panel. In this position the circuit board 168 will abut the inner face of the inner section 161 of the front panel and act as a stop or shoulder. Coacting with the circuit board 168 is a heart-shaped threaded member 173, all of which is shown in FIGS. 8 and 9 of the drawings.

The heart-shaped threaded member 173 is made of a solid plastic or the like material which is transparent or translucent and has a coacting cavity 174 to receive the LED module 165, which cavity is threaded at 175 so it can be detachably threaded and connected to the threaded portion 172 about the exterior of the tubular member 167 which extends through the opening 171 to the exterior surface 163 of the front panel 162.

With this construction as in the form of the invention above described in FIGS. 6 and 7 for the button form of the improved securement means, the heart-shaped threaded member coacts with the LED module 165 so that on operation thereof, the light from the LED element 169 will shine through the heart-shaped threaded member 173.

When the threaded member 173 is unscrewed, the LED module 165 can be removed from assembled position together with the other elements of the light illuminating assembly in a new or modified form of the LED module can be inserted or used in place of the heart-shaped design for the threaded member 173.

Though light illuminating devices or assemblies with the improved securement means for the light emitting elements in accordance with the present invention have been described with respect to certain specific embodiments thereof, this has been merely for purposes of illustration hence many variations and modifications will immediately become apparent to those skilled in the art. Therefore, the scope of the appended claims are intended to include all such variation and modifications.

What is claimed is:

1. At least one light emitting element each disposed to extend from the interior of a given piece of wearing apparel to the exterior surface thereof at a point where a decoration and the like is located comprising:

a. enclosure means about each light emitting element disposed for independent insertion through the wearing apparel so at least a portion thereof is disposed for operative relation with the decoration, b. respective means each forming an independent shoulder connected to the inner end of each enclosure means at the interior of the wearing apparel, c. each enclosure means is threaded on at least the portion which extends to the exterior of the wearing apparel, and d. respective means detachably connectable to the threaded portion of each enclosure means extending to the exterior of the wearing apparel to enable each light emitting element to be held and selectively and alternatively removed from assembled position on the wearing apparel.

2. In the light emitting element as claimed in claim 1 wherein the threaded means has a design thereon.

3. In the light emitting element as claimed in claim 2 wherein the design in heart-shaped.

4. At least one light emitting element disposed to extend from the interior of a given piece of wearing apparel to the exterior surface thereof at a point where a decoration and the like is located comprising:

a. a light element for each light emitting element, b. enclosure means about each light emitting element disposed for insertion through the wearing apparel so at least a portion thereof is disposed for operative relation with the decoration, c. each enclosure means threaded on at least the portion which extends to the exterior of the wearing apparel, d. circuit board means connected to the inner end of each enclosure at the interior of the wearing apparel to form a shoulder on each enclosure in assembled position, and e. respective threaded means detachably connectable to the threaded portion of each enclosure to enable each light emitting element to be held and selectively and alternatively removed from assembled position on the wearing apparel.

5. In the light emitting element as claimed in claim 4 wherein the threaded means has a design thereon.

6. In the light emitting element as claimed in claim 5 where the design is heart-shaped.

7. In the light emitting element as claimed in claim 6 wherein:

a. the threaded means is a solid plastic and is at least translucent, b. the threaded means has a design thereon, and c. the threaded means coacts with the light element to shine when the light element is emitting light.

8. A light illuminating assembly having at least one light emitting element usable for operative association with a decoration on the exterior of any given piece of wearing apparel comprising:

a. an enclosure means about the exterior of said at least one light emitting element to be inserted through the wearing apparel to extend to the exterior at the point thereon where the decoration is located, b. said enclosure means threaded on at least the portion which extends to the exterior of the wearing apparel, c. means forming a shoulder connected to the inner end of said enclosure, and c. threaded means for detachable connection to the exterior of the enclosure means remote from the shoulder means for holding the light emitting element for operative coaction with the decoration on the exterior of the wearing apparel for illuminating and enhancing the appearance of the decoration on operation of the light illuminating assembly.

9. In the light illuminating assembly as claimed in claim 8 which includes;

a. a battery pack, b. an electronic controller having, a switch with at least on and off positions for placing the light illuminating assembly into operation, and c. connecting means for connecting the light emitting element to the battery pack and the electronic controller so that the light emitting element will be illuminated when the switch is placed in the on position.

10. In the light emitting element as claimed in claims 8 or 9 wherein the threaded means has a design thereon.

11. In the light emitting element as claimed in claim 8 or 9 wherein the threaded means has a heart-shaped design.

12. In the light emitting element as claimed in claim 8 wherein:

a. the threaded means is a solid plastic and is at least translucent, b. the threaded means has a design thereon, and c. the threaded means coacts with the light element to shine when the light element is emitting light.

* * * * *